US005361731A

United States Patent [19]

Tanaka

[11] Patent Number: 5,361,731

[45] Date of Patent: Nov. 8, 1994

[54] SCAVENGING PORT DELIVERY FOR TWO STROKE ENGINE

[75] Inventor: Seiichi Tanaka, Hamamatsu, Japan

[73] Assignee: Sanshi Kogyo Kabushiki Kaisha, Hamamatsu, Japan

[21] Appl. No.: 101,939

[22] Filed: Aug. 4, 1993

[30] Foreign Application Priority Data

Aug. 4, 1992 [JP] Japan ..... 4-226501

[51] Int. Cl.[5] ..... F02B 33/04

[52] U.S. Cl. ..... 123/65 P; 123/73 PP

[58] Field of Search ..... 123/73 PP, 73 R, 65 P, 123/65 R

[56] References Cited

U.S. PATENT DOCUMENTS

| | | | |
|---|---|---|---|
| 3,858,562 | 1/1975 | Lanpheer | 123/65 P |
| 3,942,489 | 3/1976 | Meyer | 123/73 PP |
| 4,161,163 | 7/1979 | Boyesen | 123/73 PP |
| 4,337,734 | 7/1982 | Iio | 123/65 P |
| 5,134,976 | 8/1992 | Towner et al. | 123/65 P |
| 5,251,580 | 10/1993 | Torigai | 123/73 PP |
| 5,284,111 | 2/1994 | Geyer et al. | 123/73 PP |

*Primary Examiner*—Tony M. Argenbright
*Assistant Examiner*—M. Macy
*Attorney, Agent, or Firm*—Knobbe, Martens, Olson & Bear

[57] ABSTRACT

Embodiments of the scavenge passages and the scavenge ports for a two cycle crankcase compression engine wherein the scavenge ports have their side edges tapered outwardly to facilitate the flow into the cylinder block.

4 Claims, 3 Drawing Sheets

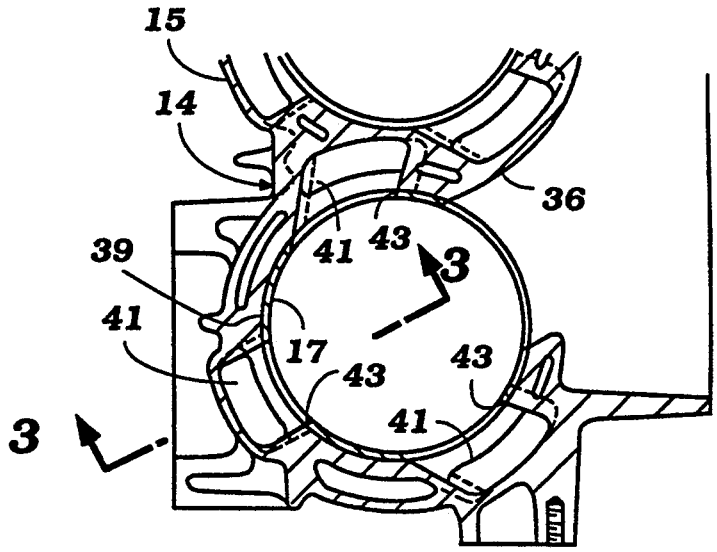
Figure 3
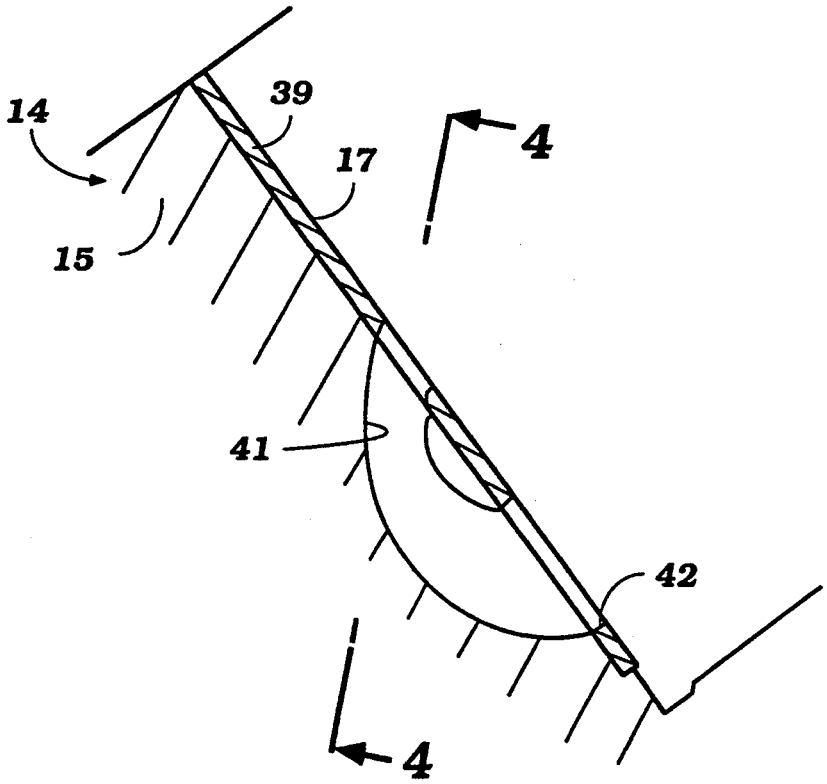

SCAVENGING PORT DELIVERY FOR TWO STROKE ENGINE

BACKGROUND OF THE INVENTION

This invention relates to a scavenge port delivery for a two stroke engine and more particularly to an improved scavenge port configuration for an engine having an cylinder liner.

With two cycle internal combustion engines in particularly those of the crankcase compression type, there are provided one or more scavenge passages that extend through the cylinder block and open into the cylinder bore through a respective scavenge port. Frequently such engines employ liners that are pressed or cast into the cylinder block and the port configuration itself is formed by the liner. Conventionally, the side edges of the scavenge port opening are generally straight. That is, they are parallel to each other and thus somewhat confine the flow of the charge which issues from them. In addition, the use of such straight edges can give rise to turbulence at the periphery and reduce air flow.

It is, therefore, a principle object of this invention to provide an improved scavenge port configuration for an internal combustion engine.

It is a further object of this invention to provide a scavenge port arrangement for an internal combustion engine wherein the scavenge port side edges have flare to them so as to promote smooth entry of the charge into the cylinder bore.

SUMMARY OF THE INVENTION

This invention is adapted to be embodied in a scavenge port arrangement for an engine having a cylinder block and a cylinder liner received in the cylinder block and defining a cylinder bore. A scavenge passage is formed in the cylinder block and terminates at the liner. A scavenge port is formed in the liner registry with the scavenge passage and has its side edges tapered convergingly in the direction leading to the center of the cylinder bore.

BRIEF DESCRIPTION OF THE DRAWINGS

FIG. 2 is an enlarged cross-sectional view taken along the line 2—2 of FIG. 1.

FIG. 3 is a further cross-sectional view taken along the line 3—3 of FIG. 2.

DETAILED DESCRIPTION OF THE PREFERRED EMBODIMENTS OF THE INVENTION

Figure 1:
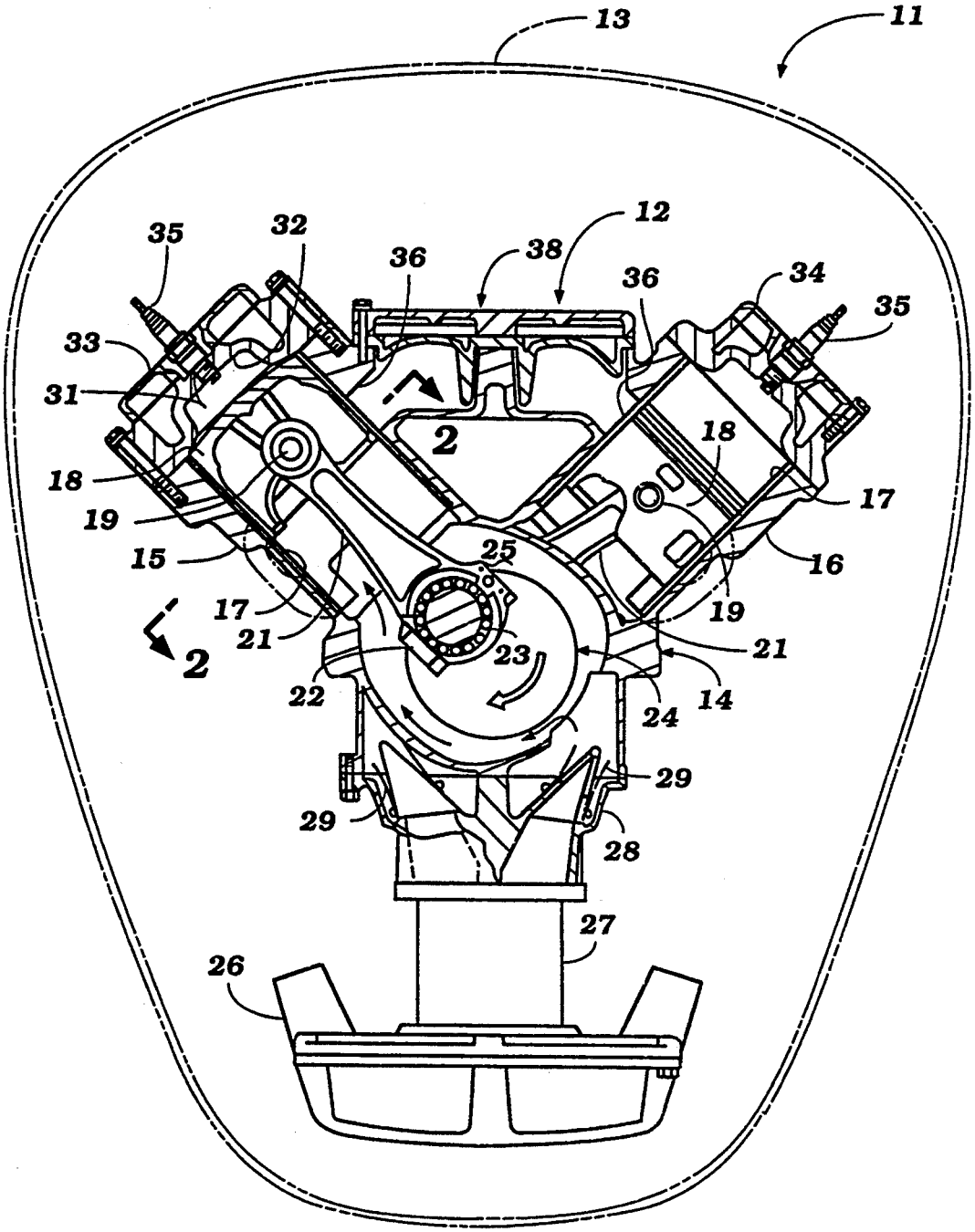
FIG. 1 is a top plan view of the powerhead of an outboard motor, with the protective cowling shown in phantom and a portion of the engine broken away and shown in cross-section.

Referring now to the drawings and initially to FIG. 1, a powerhead of an outboard motor is shown partially and is identified generally by the reference numeral 11. The invention is described in conjunction with an outboard motor because such outboard motors frequently used as their power plans two cycle crankcase compression internal combustion engines. The invention has particular utility in conjunction with such engines but may find other applications in reciprocating machines.

The powerhead 11 includes an internal combustion engine, indicated generally by the reference numeral 12 and a surrounding protective cowling shown in phantom and identified by the reference numeral 13. The auxiliaries for the engine 12 are not illustrated and the engine 12 is illustrated in part in cross-section inasmuch as the invention deals with scavenge port arrangement for the engine. For this same reason, all of the details of the engine will not be described and only those details necessary to understand the construction and operation of the scavenge port arrangement will be described.

Also, in the illustrated embodiment the engine 12 is depicted as being of the V-type and having a cylinder block 14 with a pair of angularly disposed cylinder banks 15 and 16. Although the invention is described in conjunction with such a V-type engine, it will be readily apparent to those skilled in the art that the invention may be employed in conjunction with engines having other cylinder configurations.

Each cylinder bank 15 and 16 is formed with respective cylinder bores 17, formed in a manner which will be described in detail later by reference to FIGS. 2–4. Pistons 18 reciprocate in these cylinder bores 17 and are connected by means of piston pins 19 to connecting rods 21. The connecting rods 21 have big ends 22 that are journalled on the throws 23 of a crankshaft, indicated generally by the reference numeral 24 and which is supported for rotation about a generally vertically extending axis.

The crankshaft 24 is journalled within a crankcase chamber 25 that is formed at the lower end of the cylinder block 14 below the ends of the cylinder bores 17. As is conventional with two cycle crankcase compression engines, the crankcase chambers 25 associated with each of the cylinder bores 17 are sealed from each in any known manner.

An induction system is provided for supplying at least an air charge to these crankcase chambers 25. This induction system includes an air inlet device 26 that draws atmospheric air from within the protective cowling 13 and which delvers it to a throttle body assembly 27 in which throttle valves are positioned. Alternatively, carburetors may be supplied from the air inlet device 26 and/or fuel may be injected into the throttle body 27. As a further alternative, only air may be drawn into the induction system and the engine may be provided with direct cylinder fuel injection.

The throttle body 27 cooperates with an intake manifold 28 that supplies a charge to the crankcase chambers 25 through reed type valves 29 that permit the flow into the crankcase chambers 25 but which preclude the flow in the opposite direction when the charge is compressed therein by the downward movement of the pistons 18.

The charge is compressed in the crankcase chambers 25 and is transferred to the area above the pistons 18 through scavenge passages, which will also be described in more detail by reference to FIGS. 2–4. This charge is transferred to combustion chambers 31 formed in part by recesses 32 in cylinder head assemblies 33 and 34 which are affixed to the cylinder banks 15 and 16 in a well known manner. Spark plugs 35 are mounted in the cylinder head assemblies 33 and 34 and are fired by a suitable ignition system of and known type. As has been previously noted, the fuel air charge may be formed either in the induction system or by direct fuel injection into the combustion chambers 31.

The burnt charge will expand and drive the pistons 18 downwardly. Eventually, exhaust ports 36 will be opened which are formed in a suitable manner in the cylinder banks 15 and 16 and which cooperate with an exhaust manifold 37 of any known type for discharge of the exhaust gases in any manner normally employed with outboard motor practice.

Figure 4:
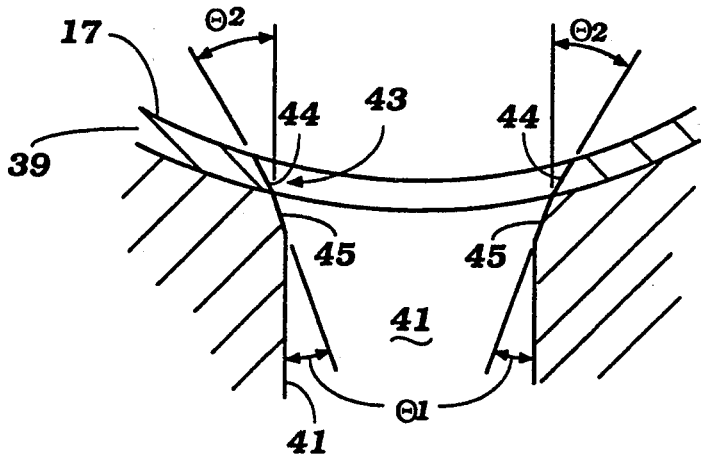
FIG. 4 is a yet further enlarged cross-sectional view taken along the line 4—4 of FIG. 3.

Referring now to FIGS. 2–4, the cylinder block 14 is provided with a plurality of either pressed or cast in cylinder liners 39 which form the cylinder bores 17. One or more scavenge passages 41 are formed in the cylinder block 14 and specifically its banks 15 and 16 that communicate at their lower ends through ports 42 with the crankcase chambers 25 in a well known manner. The ports 42 are actually formed directly in the liner 17. In the illustrated embodiment, it should be noted that there are provided three scavenge passages 41 which are disposed so as to provide a Schnurle type of scavenging. Of course, the invention may be employed with other types of scavenging arrangements.

Scavenge ports 43 are formed in the cylinder liner 17 and cooperate with each of the scavenge passages 41. Normally the sides, viewed in the direction of FIGS. 2 and 4 of the scavenge ports 43 extend parallel to each other. This provides some flow restriction and can cause undesirable turbulence in the intake charge transferred into the combustion chambers.

In accordance with the invention, the side edges, as shown in FIG. 4 and identified by the reference numerals 44, of the scavenge ports 43 are tapered through an angle $\theta_2$ as shown in FIG. 4. This tapering causes a converging relationship of the side edges 44 toward the center of cylinder bore 17. In a similar manner, adjacent edges 45 formed at the sides of the end of the scavenge passage 41 are also tapered with this taper angle being indicated at $\theta_1$. In this embodiment, the angle $\theta_1$ is less than the angle $\theta_2$ so that the discharge end of the scavenge passages 41 generally converges outwardly upon entry in the cylinder bore 17.

Figure 5:
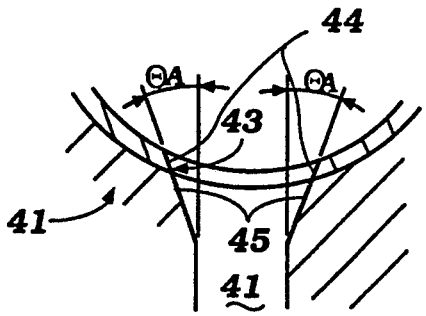
FIG. 5 is cross-sectional view, in part similar to FIG. 4, showing another embodiment and on a smaller scale.

FIG. 5 shows another embodiment of the invention and in this embodiment the tapers of the side edges 45 of the scavenge passage 41 and of the side edges 44 of the scavenge ports 43 are the same and this is indicated by the angle $\theta_A$.

Figure 6:
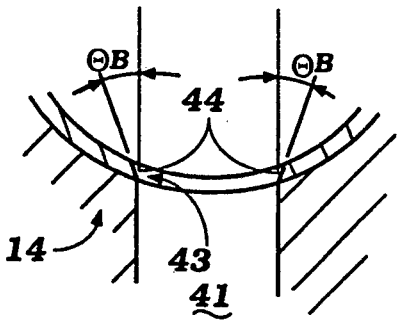
FIG. 6 is cross-sectional view, in part similar to FIGS. 4 and 5, and shows another embodiment of the invention on the same scale as FIG. 5.

FIG. 6 shows another embodiment of the invention wherein only the side edges 44 of the scavenge ports 43 are tapered and there is no taper whatsoever in the scavenge passage 41. The angle of taper of the side edges in this Figure is indicated by the angle $\theta_P$.

Thus, is should be apparent from the foregoing description that each of the embodiments of the invention are effective in providing a good scavenge port configuration that will not restrict the flow into the cylinder bores and which can be conveniently formed. Of course, the foregoing description is that of preferred embodiments of the invention and various changes in modifications may be made without departing from the spirit and scope of the invention, as defined by the appended claims.

I claim:

1. A scavenge passage arrangement for a two cycle engine having a cylinder block with a cylinder liner having a cylinder bore formed therein, a scavenge passage formed in said cylinder block and terminating at said cylinder liner, a scavenge port formed in said cylinder liner and cooperating with said scavenge passage for admitting a charge into said cylinder bore, the side edges of at least said scavenge port being tapered outwardly in a direction towards the cylinder bore.

2. A scavenge passage arrangement as set forth in claim 1 wherein the side edges of the scavenge passage adjacent to the cylinder liner are also tapered outwardly.

3. A scavenge passage arrangement as set forth in claim 2 wherein the taper of the side edges of the scavenge passage is at a different angle then the taper of the scavenge port edges.

4. A scavenge passage arrangement as set forth in claim 3 wherein the taper of the side edges of the scavenge port is greater than the taper of the side edges of the scavenge passage.

* * * * *